US011172288B1

(12) United States Patent
Mathur

(10) Patent No.: US 11,172,288 B1
(45) Date of Patent: Nov. 9, 2021

(54) METHODS AND SYSTEMS FOR MODIFYING ACOUSTICS OF A LOUDSPEAKER BACK ENCLOSURE USING ACTIVE NOISE CONTROL

(71) Applicant: Acoustic Metamaterials LLC, Scarsdale, NY (US)

(72) Inventor: Gopal Prasad Mathur, Trabuco Canyon, CA (US)

(73) Assignee: Acoustic Metamaterials LLC, Scarsdale, NY (US)

( * ) Notice: Subject to any disclaimer, the term of this patent is extended or adjusted under 35 U.S.C. 154(b) by 0 days.

(21) Appl. No.: 17/334,922

(22) Filed: May 31, 2021

Related U.S. Application Data

(60) Provisional application No. 63/051,459, filed on Jul. 14, 2020.

(51) Int. Cl.

| | |
|---|---|
| ***H04R 1/00*** | (2006.01) |
| ***H04R 3/04*** | (2006.01) |
| ***H04R 5/00*** | (2006.01) |
| ***H04R 1/32*** | (2006.01) |
| ***H04R 5/04*** | (2006.01) |
| ***H04R 5/02*** | (2006.01) |

(52) U.S. Cl.
CPC ..... *H04R 1/323* (2013.01); *H04R 3/04* (2013.01); *H04R 5/02* (2013.01); *H04R 5/04* (2013.01)

(58) Field of Classification Search
CPC . H04R 1/323; H04R 3/04; H04R 5/02; H04R 5/04; H04R 3/002; H04R 3/02; H04R 1/2834
USPC ..... 381/348, 345, 346, 353, 89, 332, 335, 381/300, 303, 304, 305, 71.7, 59, 96
See application file for complete search history.

(56) References Cited

U.S. PATENT DOCUMENTS 3,202,773 A * 8/1965 Tichy ..... H04R 1/2857 381/162
4,008,374 A * 2/1977 Tiefenbrun ..... H04R 9/04 381/89
5,237,504 A * 8/1993 Holmes ..... G01M 15/11 701/102
5,261,006 A * 11/1993 Nieuwendijk ..... H04R 1/2849 381/353
5,461,676 A * 10/1995 Hobelsberger ..... H04R 1/227 381/350
5,561,717 A * 10/1996 Lamm ..... H04R 1/02 381/89

(Continued)

*Primary Examiner* — Xu Mei
(74) *Attorney, Agent, or Firm* — Michael J. Feigin, Esq.; Feigin and Fridman LLC

(57) ABSTRACT

An active acoustics management system for the loudspeaker back-enclosure, including a first loudspeaker having a front side and a back side connected by side walls, the front facing in a first direction, is presented. An enclosure surrounds a portion of the first loudspeaker, such that the enclosure is open about the front side of the first loudspeaker and is closed about the side walls and the back side of the loudspeaker. A second loudspeaker is disposed within the enclosure behind the first loudspeaker, the second loudspeaker being oriented to output waveforms in the first direction, wherein the second loudspeaker is adapted to output waveforms in the first direction thereby to cancel at least some waveforms emanating from the back side of the first loudspeaker, using active control strategies.

12 Claims, 7 Drawing Sheets

(56) References Cited

U.S. PATENT DOCUMENTS

| | | | | |
|---|---|---|---|---|
| 6,353,670 | B1 * | 3/2002 | Gasner | H04R 1/288<br>381/59 |
| 6,408,078 | B1 * | 6/2002 | Hobelsberger | H04R 29/003<br>381/59 |
| 2009/0208025 | A1 * | 8/2009 | Hayashi | H04R 3/08<br>381/71.4 |

* cited by examiner

METHODS AND SYSTEMS FOR MODIFYING ACOUSTICS OF A LOUDSPEAKER BACK ENCLOSURE USING ACTIVE NOISE CONTROL

FIELD OF THE DISCLOSED TECHNOLOGY

The present disclosure relates generally to sound radiation from a loudspeaker, and more specifically to modifying acoustics of a speaker back enclosure using active noise control (ANC) methods.

BACKGROUND OF THE DISCLOSED TECHNOLOGY

Loudspeakers are integral/critical parts of all audio systems. Loudspeakers convert electrical energy into mechanical energy, which in turn is converted into acoustic energy.

Many loudspeakers have an enclosure on the back side of the speaker. The main objective of such an enclosure is to separate sound waves generated on the front side of the speaker from the ones generated on the back side. The sound waves generated on the front and back sides of the speaker are out of phase, and as such, they will cancel each other out when they meet or are allowed to merge, which would happen in a loudspeaker without a baffle or enclosure. Thus, all loudspeakers require some form of isolation of sound energy that radiates off the speaker's backside. Baffles, or some other sort of enclosure, are required to maintain and define a low frequency output. Enclosures are a specific way to implement an infinite baffle on a loudspeaker.

Sounds emitted by the speaker at the front and back thereof are phase shifted by exactly at 180 degree, and are thus opposite to one another. If the enclosure is not used to isolate the backward radiated sound, the backward radiated sound will cancel sound at the front by destructive interference. That will reduce speaker output greatly.

A loudspeaker enclosure can be thought of as a baffle wrapped around a loudspeaker on the back side. Thus, the loudspeaker enclosure contains all the back radiation, which would have otherwise radiated away, as well its own modal characteristics. The enclosure will obviously influence loudspeaker's front radiation.

Although placing a loudspeaker in a closed box prevents the back-tofront cancelation effect, it suffers from a shift in the output curve upward in frequency compared to the infinite baffle, as seen in FIG. 1. A bass reflex enclosure can extend the bass response significantly below the loudspeaker resonance, $f_0$.

Below the resonance frequency of the enclosure, the response of a loudspeaker in a vented enclosure degrades rapidly with a steep roll-off of 24 dB per octave. The vent, if not designed correctly or at high sound levels, can get noisy, as the air escapes the port. Transient response is not as good as that of a sealed equivalent.

The total mass $M_{tot}$, and compliance $C_{tot}$, of the loudspeaker constitute a simple mass-spring system and create a resonance at the so-called fundamental resonant frequency $f_0$, determined by $$f_0 = \frac{1}{2\pi} \sqrt{\frac{\square}{\square_{\square}\square_{\square}^{\square}}}$$

where $C_{tot}$ is the total compliance of the inner and outer suspension system and the $M_{tot}$ includes mass $M_c$ of the voice coil and voice-coil cylinder and mass $M_d$ of the cone. This frequency is mostly designed to be as low as possible since it determines the lower limit of the frequency response of the loudspeaker. In a sufficiently large baffle, pressure and power responses decrease at 24 dB per octave with decreasing frequency below $f_0$.

Since a loudspeaker diaphragm radiates on both sides, front and back, it creates acoustic pressure on its back within the enclosure. Below the resonance frequency of the enclosure, acoustic pressure changes from positive to strongly negative, which causes sudden drop in performance of the loudspeaker. Build-up of negative pressure in the enclosure causes negative axial forces on the diaphragm, which do not allow it to create sound waves efficiently on the front side. This phenomenon is due to the pressure build-up around the resonance peak in the back enclosure and exists all the way down to the lowest frequency. Thus, performance of the loudspeaker below the enclosure resonance frequency is controlled by pressure build-up in the enclosure.

Active noise control (ANC) involves an electroacoustic or electromechanical system that cancels the primary (unwanted) noise based on the principle of superposition; specifically, an anti-noise of equal amplitude and opposite phase is generated and combined with the primary noise, thus resulting in the cancellation of both noises. The ANC system efficiently attenuates low-frequency noise.

Active noise reducing headsets are used in noisy environments, such as aircraft cabins, machine rooms, heavy vehicles and army vehicles. Active noise control (ANC) headsets apply active control techniques to reduce low frequency noise in headsets. A combination of passive attenuation at the high frequencies and active attenuation at the low frequencies provides good overall performance. Most active headsets use analog feedback controllers designed around a loudspeaker and a microphone to control the sound at the ear.

Such active noise control systems contain an electroacoustic device that cancels the unwanted sound by generating an anti-sound (anti-noise) of equal amplitude and opposite phase. ANC can be implemented by using either a feedforward or a feedback technique. Analog controllers have been employed using feedback configuration for active noise cancellation in headsets.

The field of the active control of sound is well established and wide. The applications of active control are likewise varied, ranging from the complete minimization of a particular sound field, through to manipulations aimed at changing the subjective spatial impression of a space, or altering the quality of acoustic resonances.

Previously, researchers have tried to modify impedance of loudspeaker using active control. An active acoustic impedance system includes a loudspeaker in a closed cabinet connected to a feedback control loop based on a combination of pressure measured with a microphone and the velocity of the loudspeaker's membrane, acquired through an impedance bridge-motional feedback principle.

However, there remains a need in the art for methods and systems which manage acoustics of the enclosure to improve loudspeaker efficiency by use of ANC.

SUMMARY OF THE DISCLOSED TECHNOLOGY

In accordance with an embodiment of the disclosed technology, there is provided an acoustics management system, including a first loudspeaker having a front side and a back side connected by side walls, the front facing in a first direction. An enclosure surrounds a portion of the first loudspeaker, such that the enclosure is open about the front side of the first loudspeaker and is closed about the side walls and the back side of the loudspeaker. A second loudspeaker is placed within the enclosure behind the first loudspeaker, the second loudspeaker being oriented to output waveforms in the first direction, wherein the second loudspeaker is adapted to output waveforms in the first direction thereby to cancel at least some waveforms emanating from the back side of the first loudspeaker.

In some embodiments, waveforms output by the second loudspeaker are sound waveforms and the waveforms emanating from the back side of the first loudspeaker are sound waveforms. In some embodiments, waveforms output by the second loudspeaker are pressure waveforms and the waveforms emanating from the back side of the first loudspeaker are pressure waveforms.

In some embodiments, the second loudspeaker is adapted to output waveforms in a second direction, opposed to the first direction, thereby to cancel at least some waveforms emanating from the back side of the first loudspeaker.

In some embodiments, the acoustics management system further includes at least one sensor, disposed within the enclosure behind the first loudspeaker and adapted to sense at least one of the waveforms emanating from the back side of the first loudspeaker. At least one active noise cancellation (ANC) system, is adapted to receive input from the at least one sensor and, based on the input, to calculate at least one cancellation waveform corresponding to the at least one of the waveforms emanating from the back side of the first loudspeaker and to provide the at least one cancellation waveform to the second loudspeaker.

In some embodiments, the at least one ANC system includes an analogue ANC system. In some embodiments, the at least one ANC system includes a feedback ANC system. In some embodiments, the at least one ANC system includes a feed-forward ANC system.

In some embodiments, the waveforms output by the second loudspeaker are adapted to negate the at least some waveforms emanating from the back side of the first loudspeaker in a positive direction. In other embodiments, the waveforms output by the second loudspeaker are adapted to negate the at least some waveforms emanating from the back side of the first loudspeaker in a negative direction.

In some embodiments, the at least some waveforms emanating from the back side of the first loudspeaker in a positive direction have a first amplitude and a first phase, and the waveforms output by the second loudspeaker have a second amplitude and a second phase, the first amplitude being substantially equal to the second amplitude and the first phase being substantially opposite to the second phase.

In some embodiments, the acoustics management system further includes at least one mechanical arm, functionally associated with the first loudspeaker, the at least one mechanical arm adapted, following the first loudspeaker drifting from an original position relative to the enclosure, toward the second loudspeaker, to move the first loudspeaker to the original position.

In some embodiments, the at least one ANC system is adapted to operate regardless of a polarity thereof.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

The disclosed technology relates to a system and a method for active management of acoustics in a back of a loudspeaker enclosure, thereby to improve loudspeaker performance. The system may include a feedback or feedforward ANC system, a control source (such as a small loudspeaker) and one or more sensors (such as microphones). The components within the enclosure produce an "anti-noise" that cancels unwanted noise from the primary loudspeaker based on the principle of superposition. The ANC system may include adaptive digital filters in the feed-forward and feedback configurations, and may further include fixed feed-forward controllers.

For purposes of this disclosure, a "loudspeaker" is defined as an electroacoustic transducer, which converts an electrical signal into audio output.

Figure 1:
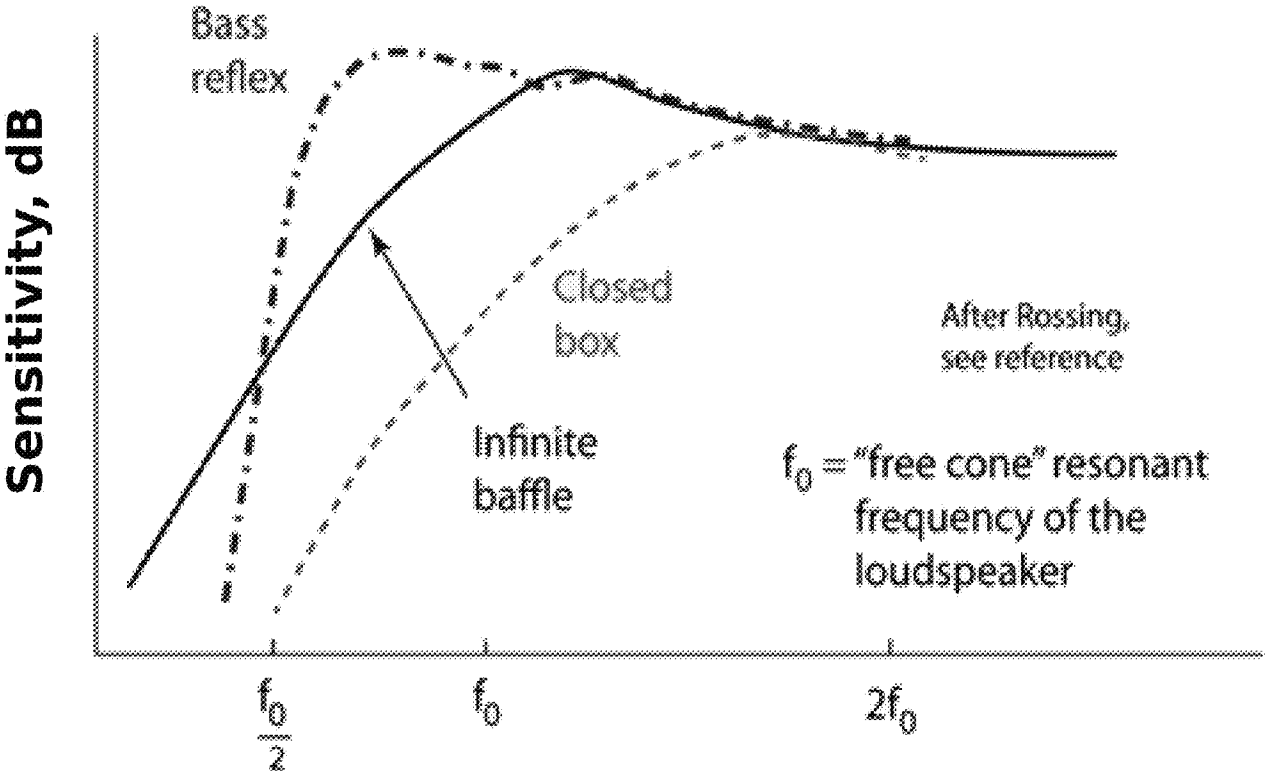
FIG. 1 (Prior Art) is a graphic representation of the effect of an enclosure on loudspeaker output.

FIG. 1 is a graphic representation of the performance of a loudspeaker in a closed enclosure, when using different types of prior art enclosures as discussed herein. As seen in FIG. 1, the performance of the loudspeaker is also impacted by the acoustics within the enclosure.

Two types of enclosures are commonly used, acoustic suspension enclosures—also called closed baffles, and bass reflex enclosures. Closed baffles and acoustic suspension enclosures use the air sealed into the enclosure as an air spring, adding to the speaker's air resonance, in order to define the low frequency output of the system. Compliance of the enclosed air in an acoustic suspension system is typically 30% or less of the compliance of the speaker. Speakers are specifically designed for sealed enclosure applications by balancing suspension stiffness with moving mass and magnet motor strength.

Bass reflex enclosures, also called vented box enclosures, are used when extended low frequency output is required. A port, also known as a vent, is added to an otherwise sealed enclosure and the port's internal diameter and length together create a Helmholtz resonance that reinforces the systems' low frequency output. As with other enclosure types, speakers are specifically designed for bass reflex applications.

However, all types of baffles and enclosures will not work equally well with all speakers. Because of the large air spring present in an infinite baffle enclosure, in such enclosures extreme cone travel will occur and allow the $X_{max}$ level to be easily exceeded. This uncontrolled cone excursion can cause increased audible distortion and risk mechanical damage to the speaker. Reducing system power will control the excursion but at the cost of reduced system output or SPL.

A variation on the 'traditional' bass reflex enclosure uses a passive radiator. This is a loudspeaker with no magnet or voice coil, and it is generally tuned for a resonant frequency somewhat below that of the woofer.

Isobaric speakers, using two speakers, are not particularly common, and are only ever used for the bass region. The benefit is that the required cabinet size is halved compared to that required for a single driver, allowing a more compact system. The disadvantage is that the efficiency is also halved, because the same power is fed to the two drivers, but output level is not increased.

Figure 2:
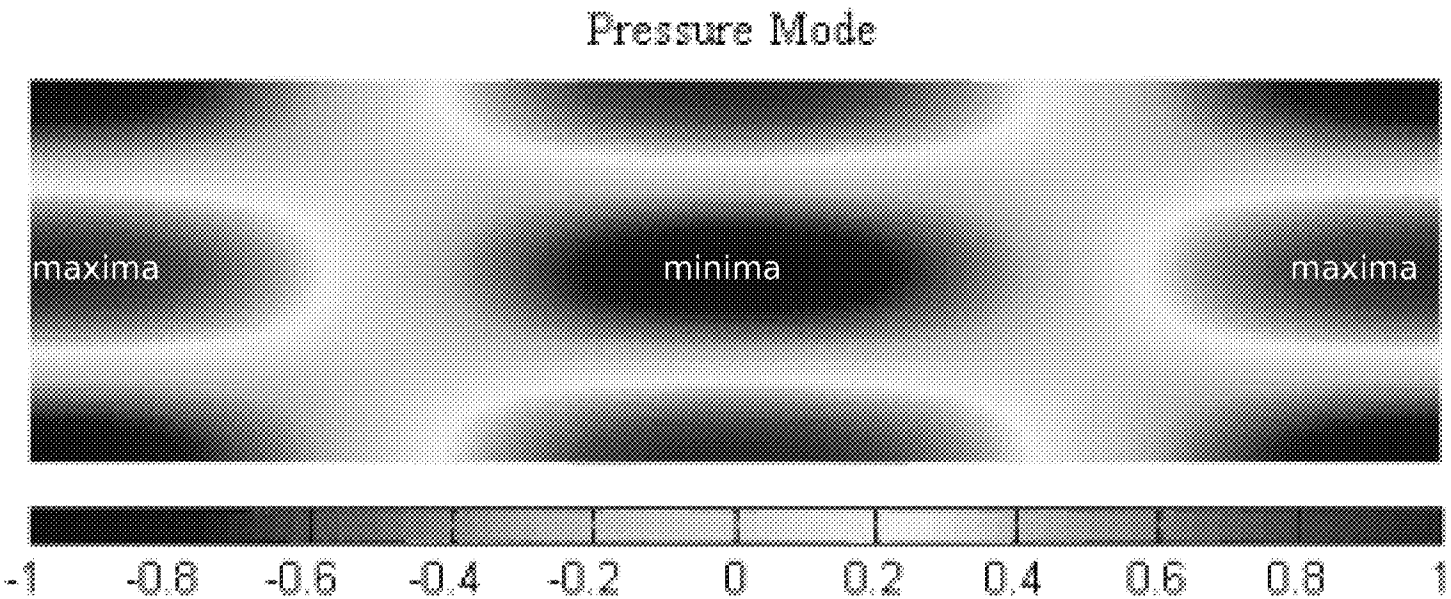
FIG. 2 (Prior Art) shows a schematic representation of pressure maxima and minima of loudspeaker output for a specific enclosure mode having Nx=2, Ny=2, Nz=0.

Standing wave phenomena occur in an enclosure at specific frequencies called the resonance frequencies of an enclosure. These frequencies depend on the dimension and shape of the enclosure. At resonance, the acoustic response of the enclosure will be enhanced. As shown in FIG. 2, pressure maxima (in red) and pressure minima (in blue) will be regularly distributed within the enclosure and their pattern will differ for each resonance frequency.

For example, in a rectangular enclosure, a simple relationship exists between its dimensions, lx, ly and lz, and the frequencies corresponding to the normal modes of vibration of the enclosure. This relationship is;

$$f = \frac{c}{2}\left[\left(\frac{N_x}{l_x}\right)^2 + \left(\frac{N_y}{l_y}\right)^2 + \left(\frac{N_z}{l_z}\right)^2\right]^{\frac{1}{2}} \text{Hz},$$

where, c is speed of sound, and $N_x$, $N_y$ and $N_z$ are mode numbers in x, y and z direction respectively.

Figure 3:
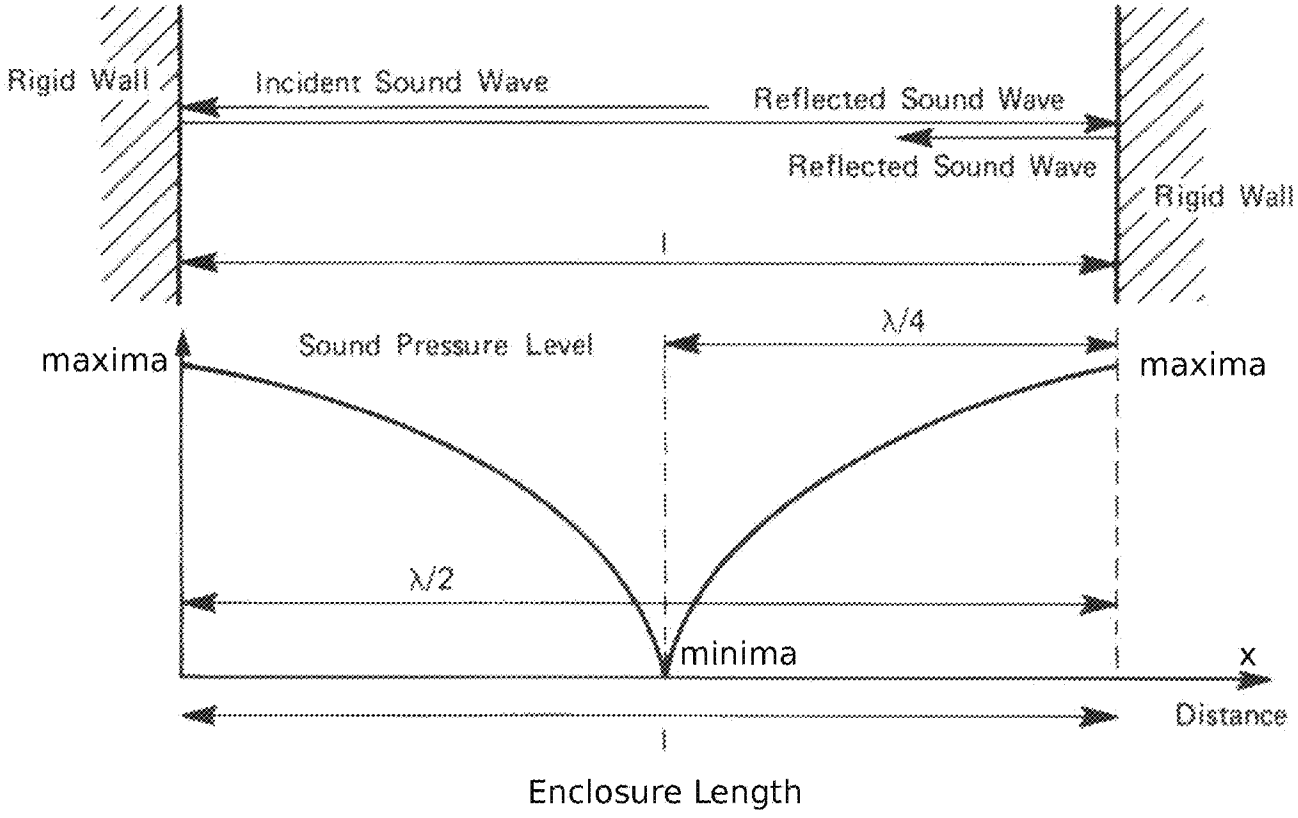
FIG. 3 (Prior Art) shows a schematic representation of a sound pressure pattern in an enclosure having an axial enclosure mode in which Nx=1, Ny=Nz=0, and with a wavelength $\lambda$ and an axial dimension of 1.

In one of the enclosure modes, called axial modes, the component waves move parallel to an axis (one dimensional, wherein two of the three indices $N_x$, $N_y$ and $N_z$ are equal to zero). Thus, axial mode (1,0,0) can be called the first axial mode of an enclosure. For an enclosure of dimensions: 0.5 m×0.22 m×0.17 m; the first axial mode (1,0,0), as shown in FIG. 3, would occur near 340 Hz assuming sound speed to be 343 m/s. Loudspeaker enclosures at low frequencies usually resonate at the first mode (1,0,0). However, due to the acoustics of the enclosure, the positive pressure field inside the enclosure will keep reducing until it changes to a negative pressure field. Below $f_0/2$, radiation from loudspeaker drops drastically due to the buildup of negative pressure in the back enclosure.

In a vented enclosure, the situation is changed by the Helmholtz resonator effect due to the presence of a vent tube. The positive pressure builds up inside the enclosure down to the resonant frequency of the Helmholtz resonator, which contributes to improved sound radiation from the loudspeaker. However, below this frequency, strong negative pressure suddenly builds up and loudspeaker efficiency drastically drops below that of loudspeaker in an infinite baffle, as observed in FIG. 1.

In a one-dimensional enclosure, natural frequencies form a harmonic series and are equally spaced with respect to frequency. In a 3-dimensional enclosure, each of the three dimensions is associated with a harmonic set of modes, and other modes are created by interactions between the dimensions. Mode spacing is therefore no longer constant and is a function of the aspect ratio of the room; on average, the modal density is directly proportional to frequency. However, the fundamental resonances of small enclosures fall inside the audio bandwidth, and the modal density is so low that the effects of individual modes are clearly audible.

As mentioned above, as the first mode in a loudspeaker enclosure may be near 330 Hz, it will affect loudspeaker output. Below this mode, the pressure field changes continuously with frequency.

Consumer electronic devices, such as cell phones, tablets, and the like with more features and capabilities are ubiquitous and are positioning to become entertainment centers. However, they also exhibit severe audio deficiencies and provide many challenges to maintain the acoustic performance as enclosed acoustic volume size, power and diaphragm size are reduced significantly. Due to the smaller size of the speaker used in such devices, the low frequency response is severely affected. For example, as the size of the cell phone decreases, the volume of air behind the diaphragm is reduced. This small amount of volume behind the speaker limits the range of motion of the diaphragm. The speaker does not produce enough force to compress the air beyond a certain point, hence causing the air to push back. This reduces the displacement of the speaker diaphragm, which in turn lowers the output. Thus, low frequencies are affected the most by this phenomena, as the diaphragm moves with the largest amount of displacement at these frequencies. Consequently, the frequency response usually rolls off faster at low frequencies (<300 Hz).

The resonance frequency of micro-speakers used on consumer audio devices is around 1000 Hz. Below the diaphragm resonance frequency, the sound output of the micro-speaker falls at the rate of 12 dB per octave.

Thus, two key phenomena, namely high resonance frequency of diaphragm and small amount of back volume, severely impact performance of micro-speakers.

Turning to FIGS. 4A and 4B, it is seen that an acoustics management system 10 according to the disclosed technology includes a primary loudspeaker 12 having a front side 12*a* and a back side 12*b*, the front side 12*a* facing in a first direction indicated by arrow 14. Primary loudspeaker 12 is disposed within an enclosure 16, which enclosure is substantially open in front of the speaker (in direction 14) and is closed at the sides and back (in a direction opposed to direction 14) of primary loudspeaker 12. At least one noise cancellation loudspeaker 18 is disposed within enclosure 16 behind primary speaker 12, and is oriented in the first direction, such that output of noise cancellation loudspeaker 18 is directed toward a back side of primary loudspeaker 12. In this configuration, soundwaves or pressure output from primary loudspeaker 12 toward the back of the enclosure, indicated by waveforms 20, and sound or pressure output from noise cancellation loudspeaker 18 toward the back side 12*b* of the primary loudspeaker, indicated by waveforms 21, are superposed, such that at least some sound or pressure emanating from the back side 12*b* of the primary loudspeaker 12 is canceled. In some embodiments, the sound or pressure output from noise cancellation speaker 18 is adapted to completely negate sound or pressure emanating from the back side 12*b* of the primary loudspeaker.

In some embodiments, at least one sensor 22, such as a pressure sensor or a sound sensor, is disposed within enclosure 16 between primary loudspeaker 12 and noise cancellation loudspeaker 18. Sensor(s) 22 is adapted to sense pressure or sound waves generated by the primary speaker in the second direction 20, and to provide transmissions to at least one ANC system 24, disposed within enclosure 16. The ANC system(s) 24 is functionally associated with the noise cancellation loudspeaker 18, and is adapted to calculate, based on transmissions received from sensor(s) 22, a corresponding pressure or sound waveform, and to transmit the calculate pressure or sound waveform to noise cancellation loudspeaker 18 for emission thereby.

As explained in further detail herein below, in some embodiments the ANC system(s) 24 may include a feedback ANC system, for example using adaptive digital filters, and in some embodiments the ANC system(s) 24 may include a feed-forward ANC system, for example using adaptive digital filters and/or fixed feed-forward controllers. In some embodiments the ANC system(s) 24 may include analogue control hardware.

In some embodiments, the sound or pressure output by noise cancellation loudspeaker 18 is adapted to negate sound or pressure output from back side 12*b* of primary loudspeaker 12 in a positive direction (in a direction where the primary speaker is primarily propagating waves). In some embodiments, the sound or pressure output by noise cancellation loudspeaker 18 is adapted to negate sound or pressure output from back side 12*b* of primary loudspeaker 12 in a negative direction.

In some embodiments, the waveform of sound or pressure 21 output by said noise cancellation loudspeaker 18 has a substantially equal amplitude, and opposite phase, to the amplitude and phase of the waveform of sound or pressure 20 emanating from back side 12*b* of primary speaker 12.

In some embodiments, system 10 further includes at least one mechanical arm 26, adapted to move primary loudspeaker 12 into its original location, if the primary loudspeaker moves toward noise cancellation loudspeaker 18.

As a practical approximation of the energy minimization strategy useful in the disclosed technology, pressure at a number of discrete locations of sensors 22 can be minimized. Corner sensor locations offer the most economic route to such an approximation, and these locations offer reasonable performance even where modal degeneracy means that the pressure response is made up of two or three dominant contributions.

Total active modification of a mode can occur regardless of the distribution of sound from primary loudspeaker 12, if the number of active secondary sound sources, such as noise cancellation loudspeaker(s) 18, is equal to the number of modes.

The active control of acoustic impedance near or at a diaphragm surface of primary loudspeaker 12 can also be used as a strategy for the modification of a modal sound field inside the enclosure 16. Although loudspeaker diaphragm impedance can be taken as error input, it only addresses loudspeaker acoustic radiation and not the whole acoustic field of the enclosure.

For the case of frequencies well below first mode (1,0,0) of the enclosure 16, a single sensor 22 and noise cancellation loudspeaker 18 (secondary electroacoustic control source) can be used in the enclosure to control the frequency, spatial and time domain artifacts associated with discrete low frequency mode. The main objective is the integration of a controller with a sensor, which may operate on acoustic or electro acoustic signals.

Figure 4:
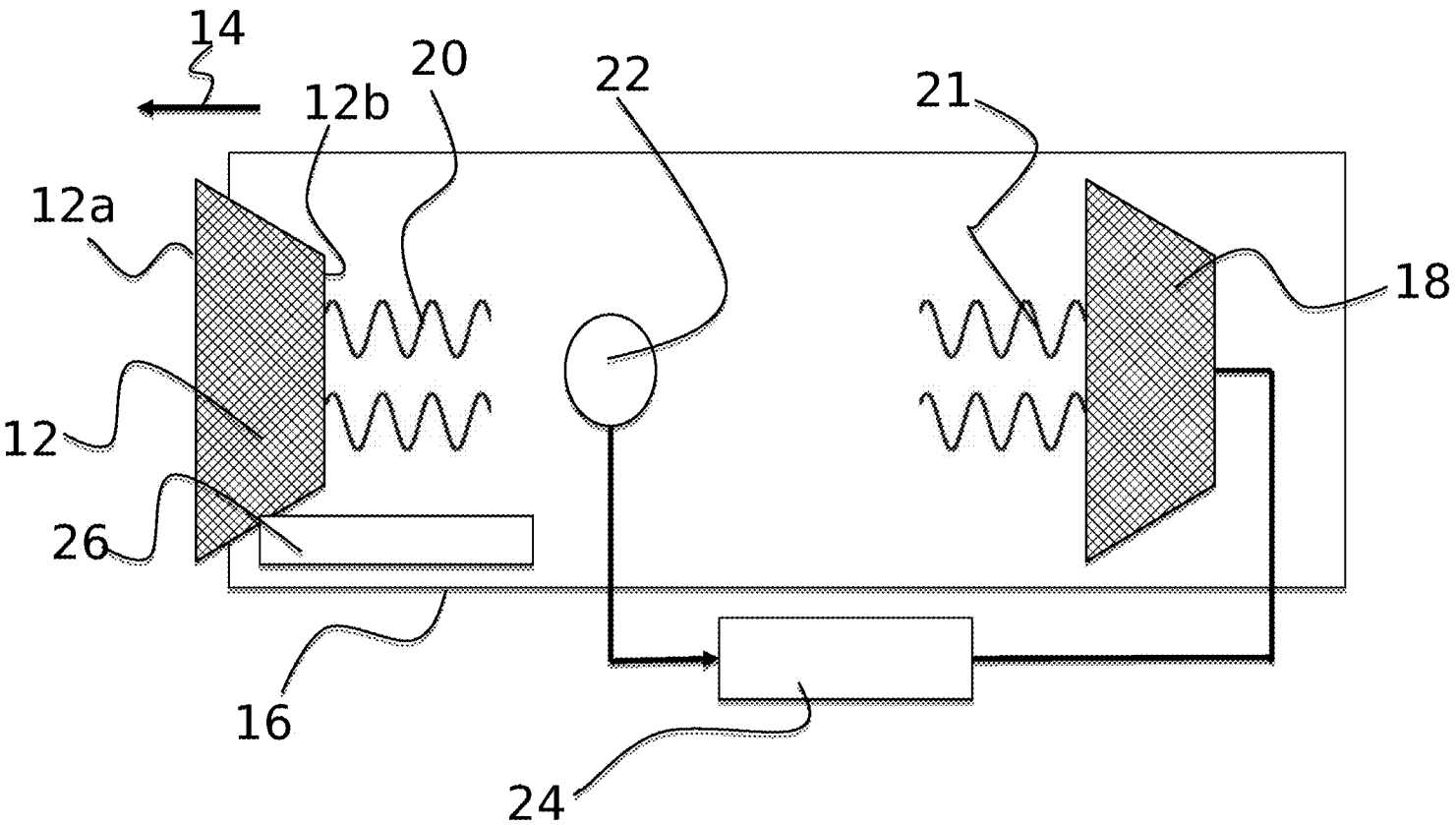
FIG. 4 is a schematic perspective view illustration and a block diagram of an acoustic management system using an ANC system according to an embodiment of the disclosed technology.

Since noise cancellation loudspeaker(s) 18 (control source(s)) would be added to the baseline enclosure, its size should preferably not be increased. This means that noise cancellation loudspeaker(s) 18 must be accommodated inside the existing enclosure as shown in FIG. 4. Thus, the baseline enclosure dimensions can be optimized and re-sized according to the primary loudspeaker 12 and noise cancellation loudspeaker(s) 18.

In some embodiments, enclosure 16 includes a secondary enclosure (not explicitly shown). Noise cancellation loudspeaker 18, which could be a small loudspeaker, can be added to the second enclosure. If noise cancellation loudspeaker 18 is a piezo-electric actuator mounted on one of the walls of the enclosure, then there will be no need to add a second enclosure.

In some embodiments, in addition to being useful for augmenting acoustic characteristics of an enclosure at low frequencies, the disclosed technology may be used to modify enclosure acoustics associated with modes such as (1,0,0) and other higher order modes. However, in such cases, additional sensors 22 and noise cancelling sources 18 (e.g., loudspeakers, piezo-electric drivers on enclosure walls, etc.) may be added.

As is known in the art, and as discussed hereinabove, there are two different approaches to active noise control: feedback and feed-forward. Feed-forward control anticipates and corrects for errors before they happen. Feedback control adjusts for errors as they take place. Practically all analog implementations are restricted to feedback control, as feed-forward control would require one or more analog filters combined with one or more analog delay lines, which would be unadaptive, despite their complexity. Active control of the loudspeaker enclosure 16 can work with both feed-forward and feed-back approaches.

The feed-forward control is exemplified by the single-channel ductacoustic ANC system shown in FIG. 4A, where the reference input (wave-forms 20 emanating from back side 12*b* of primary loudspeaker 12) is picked up by a microphone (sensor 22). The reference input is processed by the ANC system 24 to generate the control signal to drive noise cancellation loudspeaker 18. The error microphone (sensor 22) is used to monitor the performance of the ANC system 24. The objective of ANC system 24 is to minimize or modify the measured acoustic noise, which in present case is unwanted back radiation in the enclosure 16.

Figure 5:
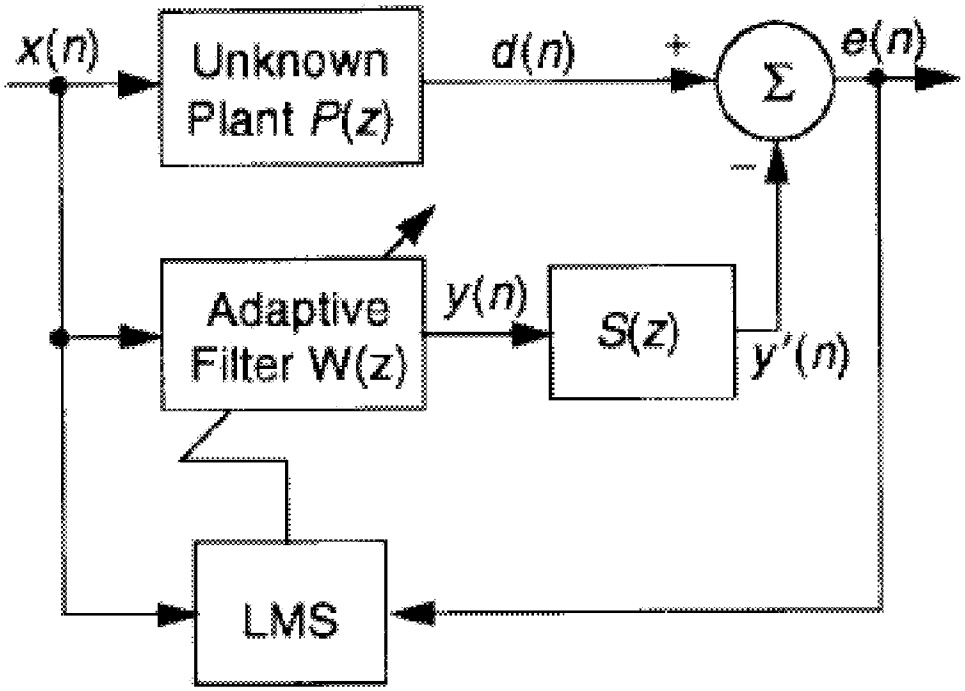
FIG. 5 is a block diagram of a single channel feed-back active noise control system suitable for use in the system of FIG. 4, according to an embodiment of the disclosed technology.

As mentioned, the system of FIG. 4, the ANC system may be a feedback system. A block diagram for a ingle-channel feedback ANC system is presented in FIG. 5. The transmission(s) from sensor 22 is processed by an ANC system to generate the secondary transmission. A single-channel adaptive feedback ANC system can be extended to the multiple-channel case. This technique can be viewed as an adaptive feed-forward system that, in effect, synthesizes, or regenerates, its own reference signal, based only on the adaptive filter output and error signal.

Although it is desirable for the ANC system 24 to be digital, where signals from electroacoustic or electromechanical transducers are sampled and processed in real time using digital signal processing (DSP) systems, analogue feed-back implementation can be used.

The least mean square (LMS) algorithm is well known in the art of active noise control. The least mean square (LMS) algorithm has proved to be a robust algorithm for adaptation of transversal digital filters used for different applications. In an active noise control loop, the output of the adaptive filter drives the secondary path, and the error signal is derived only at the error transducer, i.e., microphone. In such cases, a simple LMS algorithm can be unstable due to the phase shift caused by the secondary path. The problem is solved by using a filtered reference or filtered-X LMS algorithm.

Figure 6:
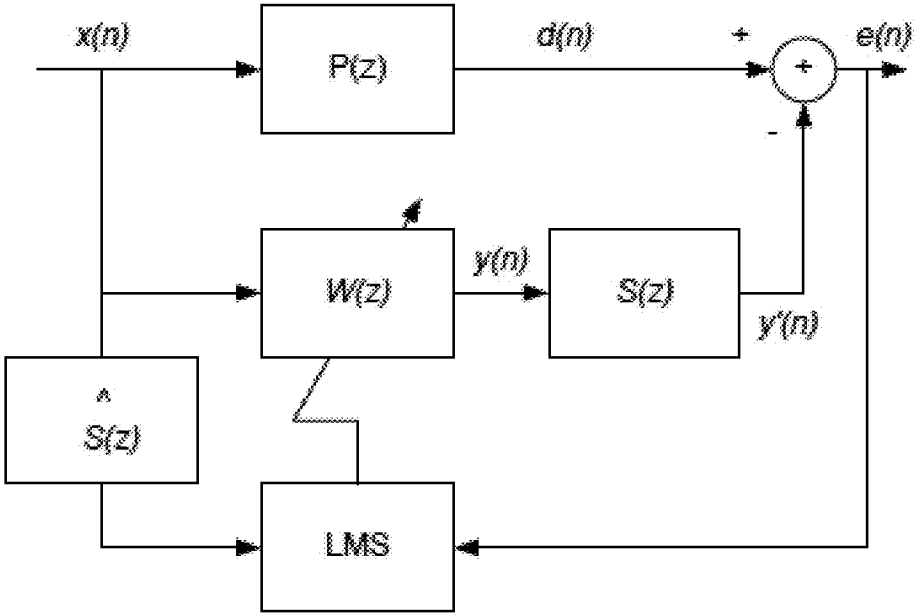
FIG. 6 is a simplified block diagram of a filtered-X least-mean-square (LMS) active noise control system suitable for use in the system of FIG. 4, according to an embodiment of the disclosed technology.

FIG. 6 shows an exemplary ANC system, usable in system 10 of FIG. 4, which uses the filtered-X LMS algorithm. As seen in FIG. 6, the objective of the adaptive filter W(z) is to minimize the residual error signal e(n). After the adaptive filter converges, E(z)=0. It then gives W(z)=P(z) for X(z)≠0, which implies that $y_n=d_n$ Therefore, the adaptive filter output y(n) is identical to the primary disturbance d(n). When d(n) and y(n) are acoustically combined, the residual error is e(n)=d(n)−y(n)=0, which results in perfect cancellation of both sounds based on the principle of superposition. It is necessary to compensate for the secondary-path transfer function S(z) from y(n) to e(n) which includes the digital-to-analog (D/A) converter, reconstruction filter, power amplifier, loudspeaker, acoustic path from loudspeaker to error microphone, error microphone, preamplifier, antialiasing filter, and analog-to digital (A/D) converter.

The cost and electric power used with the system of the disclosed technology is estimated to be lower than that of using two loudspeakers, when overall performance improvement is considered.

Figure 7:
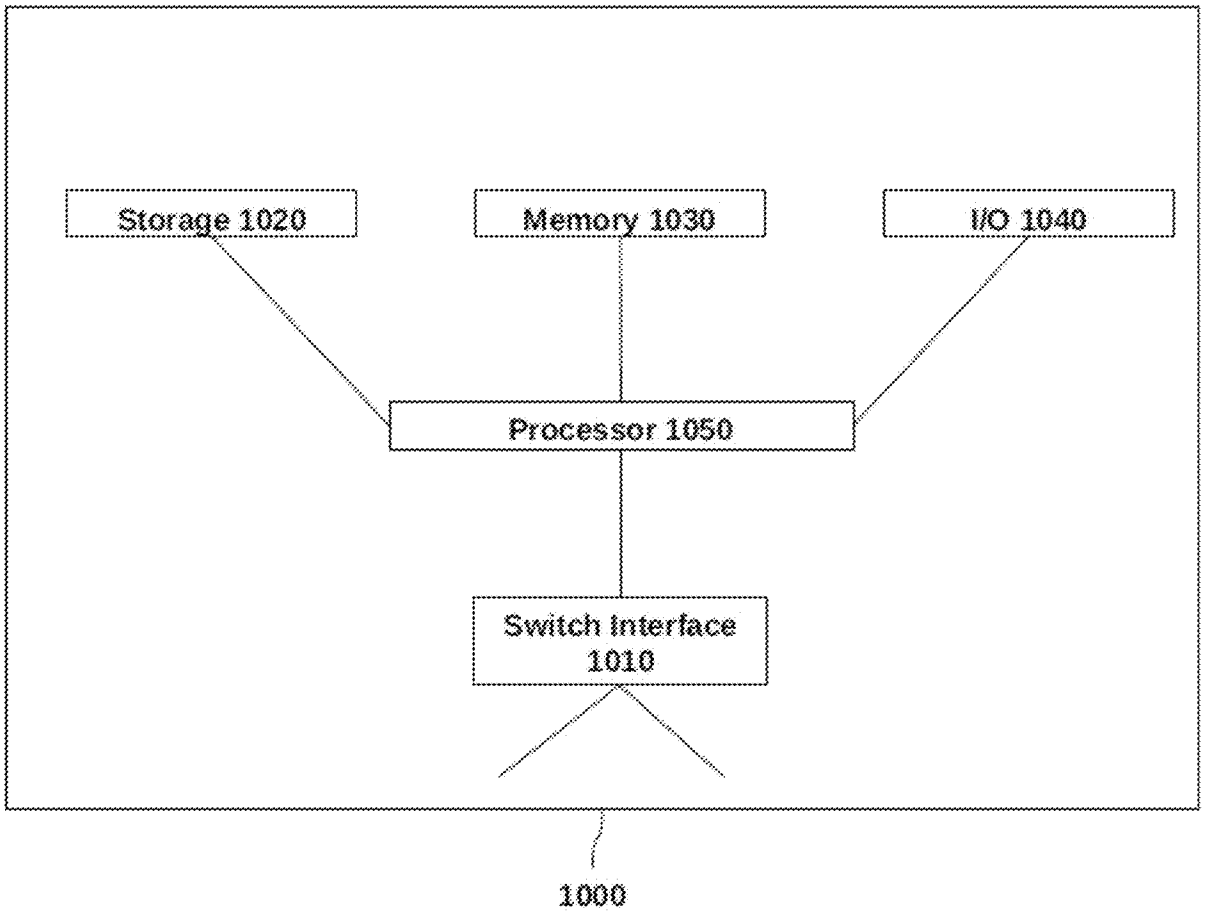
FIG. 7 is a high level block diagram showing devices on which embodiments of the disclosed technology may be carried out.

FIG. 7 shows a high-level block diagram of a device that may be used to carry out the disclosed technology. Device 1000 comprises a processor 1050 that controls the overall operation of the computer by executing the device's program instructions which define such operation. The device's program instructions may be stored in a storage device 1020 (e.g., magnetic disk, database) and loaded into memory 1030, when execution of the console's program instructions is desired. Thus, the device's operation will be defined by the device's program instructions stored in memory 1030 and/or storage 1020, and the console will be controlled by processor 1050 executing the console's program instructions. A device 1000 also includes one, or a plurality of, input network interfaces for communicating with other devices via a network (e.g., the Internet). The device 1000 further includes an electrical input interface. A device 1000 also includes one or more output network interfaces 1010 for communicating with other devices. Device 1000 also includes input/output 1040, representing devices which allow for user interaction with a computer (e.g., display, keyboard, mouse, speakers, buttons, etc.). One skilled in the art will recognize that an implementation of an actual device will contain other components as well, and that FIG. 7 is a high level representation of some of the components of such a device, for illustrative purposes. It should also be understood by one skilled in the art that the method and devices depicted in FIGS. 4 through 6 may be implemented on a device such as is shown in FIG. 7.

Further, it should be understood that all subject matter disclosed herein is directed, and should be read, only on statutory, non-abstract subject matter. All terminology should be read to include only the portions of the definitions which may be claimed. By way of example, "computer readable storage medium" is understood to be defined as only non-transitory storage media.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. An active acoustics management system, comprising:

a first loudspeaker having a front side and a back side connected by side walls, said front facing in a first direction;

an enclosure surrounding a portion of said first loudspeaker, such that said enclosure is open about said front side of said first loudspeaker and is closed about said side walls and said back side of said loudspeaker;

a second loudspeaker, disposed within said enclosure behind said first loudspeaker, said second loudspeaker being oriented to output waveforms in said first direction; and at least one mechanical arm, functionally associated with said first loudspeaker, said at least one mechanical arm adapted, following said first loudspeaker drifting from an original position relative to said enclosure, toward said second loudspeaker, to move said first loudspeaker to said original position, wherein said second loudspeaker is adapted to output waveforms in said first direction thereby to cancel at least some waveforms emanating from said back side of said first loudspeaker.

2. The acoustics management system of claim 1, wherein waveforms output by said second loudspeaker are sound waveforms and said waveforms emanating from said back side of said first loudspeaker are sound waveforms.

3. The acoustics management system of claim 1, wherein waveforms output by said second loudspeaker are pressure waveforms and said waveforms emanating from said back side of said first loudspeaker are pressure waveforms.

4. The acoustics management system of claim 1, wherein said second loudspeaker is adapted to output waveforms in a second direction, opposed to said first direction, thereby to cancel at least some waveforms emanating from said back side of said first loudspeaker.

5. The acoustics management system of claim 1, further comprising:

at least one sensor, disposed within said enclosure behind said first loudspeaker and adapted to sense at least one of said waveforms emanating from said back side of said first loudspeaker; and at least one active noise cancellation (ANC) system, adapted to receive input from said at least one sensor and, based on said input, to calculate at least one cancellation waveform corresponding to said at least one of said waveforms emanating from said back side of said first loudspeaker and to provide said at least one cancellation waveform to said second loudspeaker.

6. The acoustics management system of claim 5, wherein said at least one ANC system includes an analogue ANC system.

7. The acoustics management system of claim 5, wherein said at least one ANC system includes a feed-forward ANC system.

8. The acoustics management system of claim 5, wherein said at least one ANC system includes a feedback ANC system.

9. The acoustics management system of claim 1, wherein said waveforms output by said second loudspeaker are adapted to negate said at least some waveforms emanating from said back side of said first loudspeaker in a positive direction.

10. The acoustics management system of claim 1, wherein said waveforms output by said second loudspeaker are adapted to negate said at least some waveforms emanating from said back side of said first loudspeaker in a negative direction.

11. The acoustics management system of claim 1, wherein said at least some waveforms emanating from said back side of said first loudspeaker in a positive direction have a first amplitude and a first phase, and said waveforms output by said second loudspeaker have a second amplitude and a second phase, said first amplitude being substantially equal to said second amplitude and said first phase being substantially opposite to said second phase.

12. The acoustics management system of claim 1, wherein said at least one ANC system is adapted to operate regardless of a polarity thereof.

* * * * *